United States Patent [19]

Sakai

[11] Patent Number: 4,541,370

[45] Date of Patent: Sep. 17, 1985

[54] INTAKE AND EXHAUST PASSAGES IN CYLINDER HEADS OF AN OPPOSED-CYLINDER ENGINE

[75] Inventor: Tatsuo Sakai, Tokyo, Japan

[73] Assignee: Fuji Jukogyo Kabushiki Kaisha, Tokyo, Japan

[21] Appl. No.: 558,632

[22] Filed: Dec. 6, 1983

[30] Foreign Application Priority Data

Dec. 7, 1982 [JP] Japan ..... 57-214145

[51] Int. Cl.[4] ..... F02B 75/24

[52] U.S. Cl. ..... 123/56 AC; 123/52 MC; 123/193 H

[58] Field of Search ..... 123/56 R, 52 M, 52 MC, 123/56 A, 56 AC, 56 BC, 193 R, 193 H

[56] References Cited

U.S. PATENT DOCUMENTS 2,664,864 1/1954 Ernest ..... 123/52 MC 2,969,781 1/1961 Kolbe ..... 123/56 AA

*Primary Examiner*—Craig R. Feinberg

*Attorney, Agent, or Firm*—Martin A. Farber

[57] ABSTRACT

Intake and exhaust passages in cylinder heads of an opposed six-cylinder engine. The cylinder heads are disposed on opposite sides of a crankcase including cylinder blocks. Intake valves and exhaust valves in each cylinder are disposed in the same arrangement at every so that the distance between the intake valves are equal to each other, and an intake passage in each cylinder head is so formed as to communicate the intake valves with two openings. The openings are located at a position between adjacent intake valves so that the intake passages for every cylinder are equal in length and exahust passages are exclusively provided for each exhaust valve.

3 Claims, 6 Drawing Figures

INTAKE AND EXHAUST PASSAGES IN CYLINDER HEADS OF AN OPPOSED-CYLINDER ENGINE

BACKGROUND OF THE INVENTION

The present invention relates to intake and exhaust passages in cylinder heads of an opposed-cylinder engine.

FIG. 1 schematically shows an opposed six-cylinder engine.

The opposed six-cylinder engine comprises a crankcase A including a pair of cylinder blocks B formed on opposite sides thereof and cylinder head 1 and 1' secured to the cylinder blocks. Three cylinders are formed in each cylinder block.

FIG. 2 shows one of the conventional cylinder heads as viewed from the inside thereof. The cylinder head has combustion chambers 2*a* for a No. 1 cylinder, 2*b* for a No. 3 cylinder and 2*c* for a No. 5 cylinder. Intake valves 3*a*, 3*b* and 3*c* and exhaust valves 4*a*, 4*b* and 4*c* are provided for respective combustion chambers in the cylinder head. A siamese intake passage 6*ab* is formed in the cylinder head to communicate intake valve ports of the intake valves 3*a* and 3*b* with a single opening 5*ab*. The valve port of the intake valve 3*c* is communicated by a single passage 6*c* with an opening 5*c*. The openings 5*ab* and 5*c* are communicated with an intake manifold 10 (FIG. 1). Similarly, valve ports of the exhaust valves 4*a* and 4*b* are communicated with an opening 8*ab* by a siamese exhaust passage 7*ab* and the port of the exhaust valve 4*c* is communicated with an opening 8*c* by a passage 7*c*.

In the other cylinder head 1', intake and exhaust passages are formed in the same manner as the cylinder head 1. FIG. 3 shows both cylinder heads disposing in adjacent positions for the convenience of explanation. In the cylinder head 1', a combustion chamber 2*c'* for the No. 2 cylinder, combustion chamber 2*b'* for the No. 4 cylinder and combustion chamber 2*a'* for the No. 6 cylinder are formed. Intake passages 6*ab'* and 6*c'* and exhaust passages 7*ab'* and 7*c'* are arranged in symmetry with respect to an axis for balancing the cylinder heads.

In such an arrangement, since intake valves 3*a* and 3*c* are disposed at outermost positions, the length of each intake passage becomes long in order to equalize the length one of the passages with the length of the others. Therefore, the amount of inducted air becomes small, which causes a reduction of combustion efficiency.

On the other hand, the intake strokes of the No. 1 cylinder and No. 3 cylinder overlap with each other as shown in FIG. 6. Since both cylinders are communicated by the siamese intake passage 6*ab*, a large amount of air is induced into the No. 3 cylinder, which fires later in the firing order than the No. 1 cylinder, by the inertia of the air induced into the No. 1 cylinder. Further, during the overlapping of the exhaust stroke and the intake stroke of the No. 1 cylinder, residual gases in the exhaust passage of the No. 3 cylinder during the exhaust stroke are induced into the No. 1 cylinder. Therefore, combustion in No. 1 is unequalized in idling operation of the engine. When the No. 6 cylinder begins to induce the air after No. 4, the No. 6 cylinder is the same as the No. 1 cylinder in deterioration of combustion.

In addition, in the siamese exhaust passage 7*ab*, exhaust gases from both cylinders interfere with each other, particularly at wide open throttle, which will result in reduction of the power of the engine.

SUMMARY OF THE INVENTION

The object of the present invention is to provide intake and exhaust passages in cylinder heads of an opposed-cylinder engine which may equally induce the air into each cylinder and prevent inducing residual gases in the exhaust passage.

The other objects and features of this invention will be apparently understood from the following description with reference to the accompanying drawings.

DETAILED DESCRIPTION OF THE PREFERRED EMBODIMENT

Figure 1:
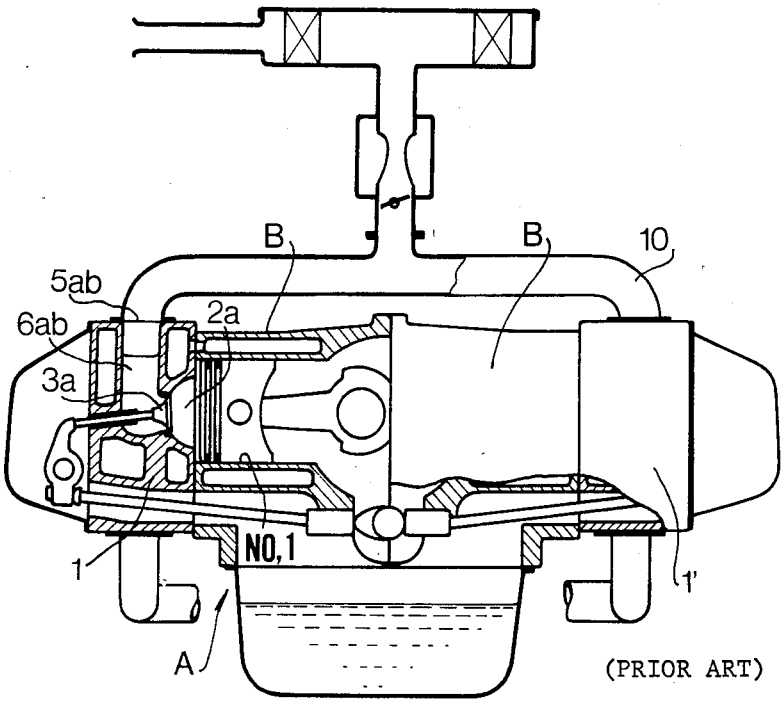
(PRIOR ART) FIG. 1
FIG. 1 schematically shows an example of an opposed six-cylinder engine.
Figure 2:
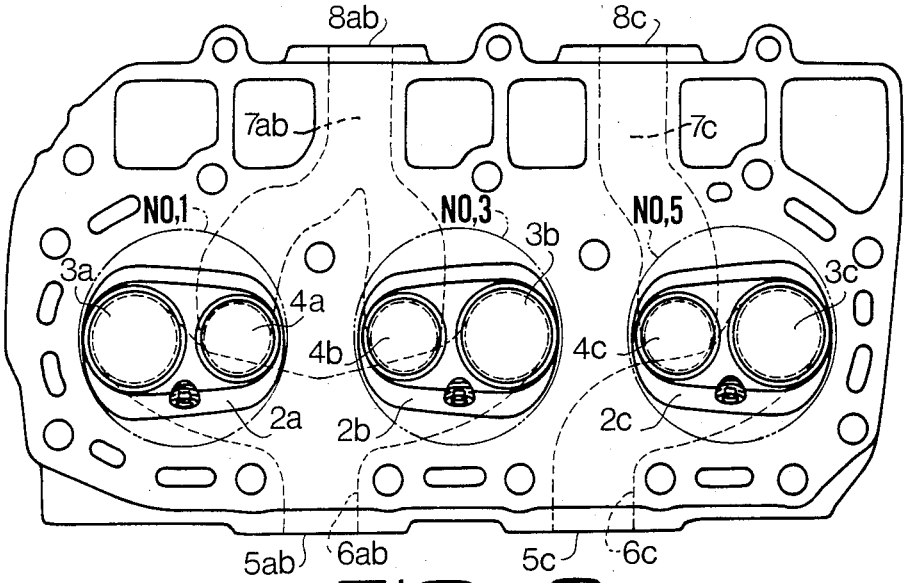
FIG. 2 (PRIOR ART)
FIG. 2 shows a cylinder head of a conventional engine as viewed from the inside thereof.
Figure 3:
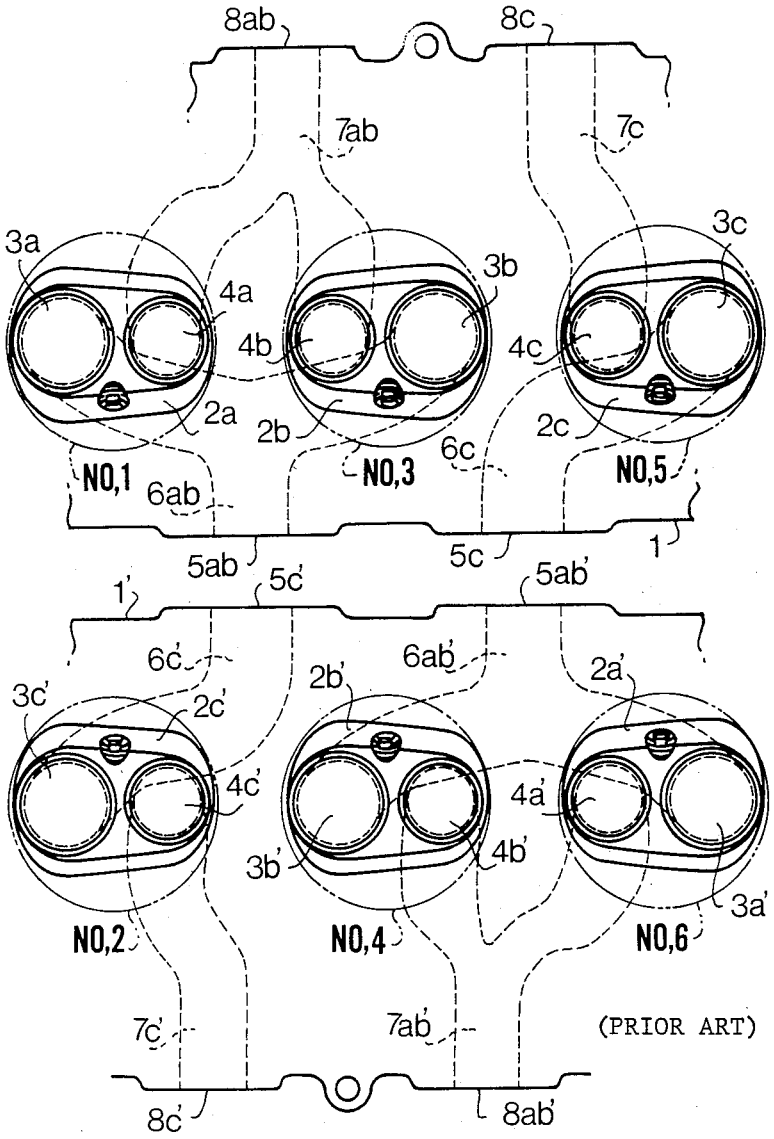
FIG. 3 shows cylinder heads of a six-cylinder engine.
Figure 4:
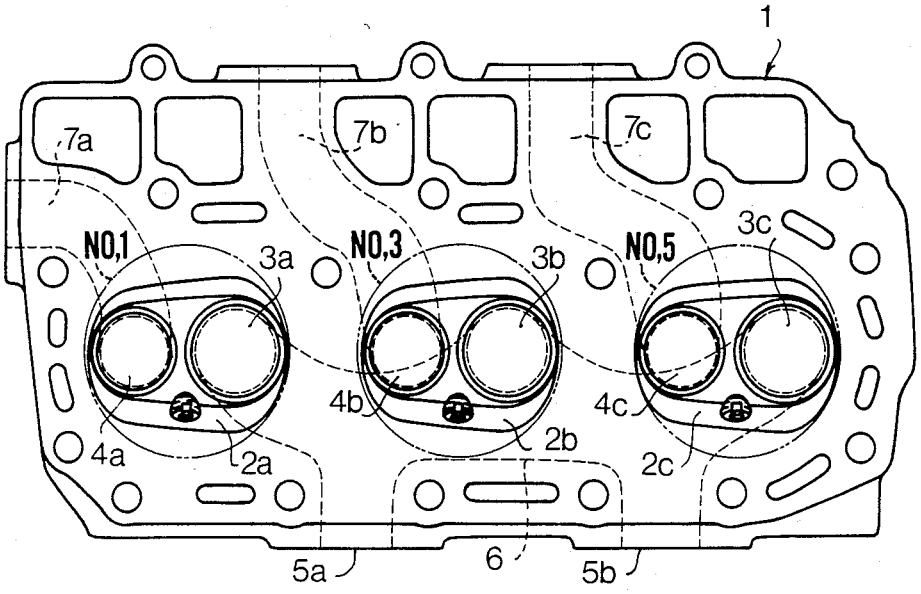
FIGS. 4 and 5 show an embodiment of the present invention.
Figure 5:
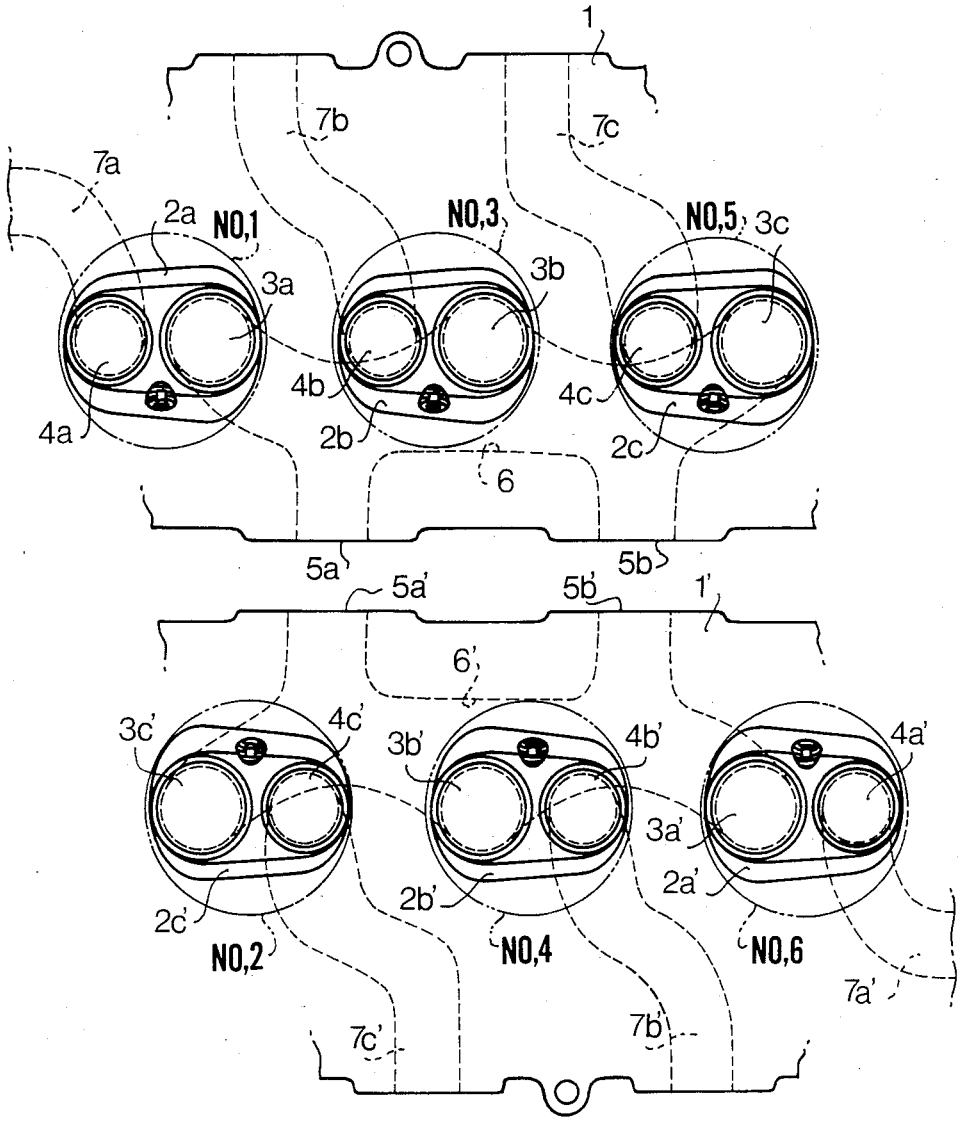

Referring to FIGS. 4 and 5, intake valves 3*a* to 3*c* and exhaust valves 4*a* to 4*c* in the cylinder head 1 are disposed in the same arrangement or order to every cylinder, so that the distances between the intake valves are respectively equal, and also the distances between the exhaust valves are equal, respectively. A common intake passage 6 is provided in the cylinder head 1 for the intake valves 3*a* to 3*c*, so that the length of the passage between adjacent intake valves 3*a* and 3*b* is equal to the length of the passage between the intake valves 3*b* and 3*c*. An opening 5*a* for the common intake passage 6 is provided between the intake valves 3*a* and 3*b* and an opening 5*b* is provided between the intake valves 3*b* and 3*c*. As seen from the drawings, the length of the passage of the present invention is shorter than that of FIG. 2. Exhaust passages 7*a*, 7*b* and 7*c* are exclusively provided for communicating the exhaust valves 4*a*, 4*b* and 4*c* with respective openings.

Each exhaust passage has a sufficient sectional area so as to decrease the resistance of the exhaust gases and to prevent the interference of exhaust gases and to prevent inducing residual gases in the exhaust passage.

As shown in FIG. 5, passages in the cylinder head 1' are arranged in a similar manner as the cylinder head 1. Since the intake passages for every cylinder are the same in construction and length, the air is equally induced into each cylinder. Further, the inertia of the intake air acts equally in each passage thereby to increasing the amount of intake air. Since each cylinder is communicated with the opening through the shortest passage, a large amount of air can be induced as a result of small resistance. In addition, the residual gases in the exhaust gases are prevented from being induced by the independent exhaust passage arrangement.

Figure 6:
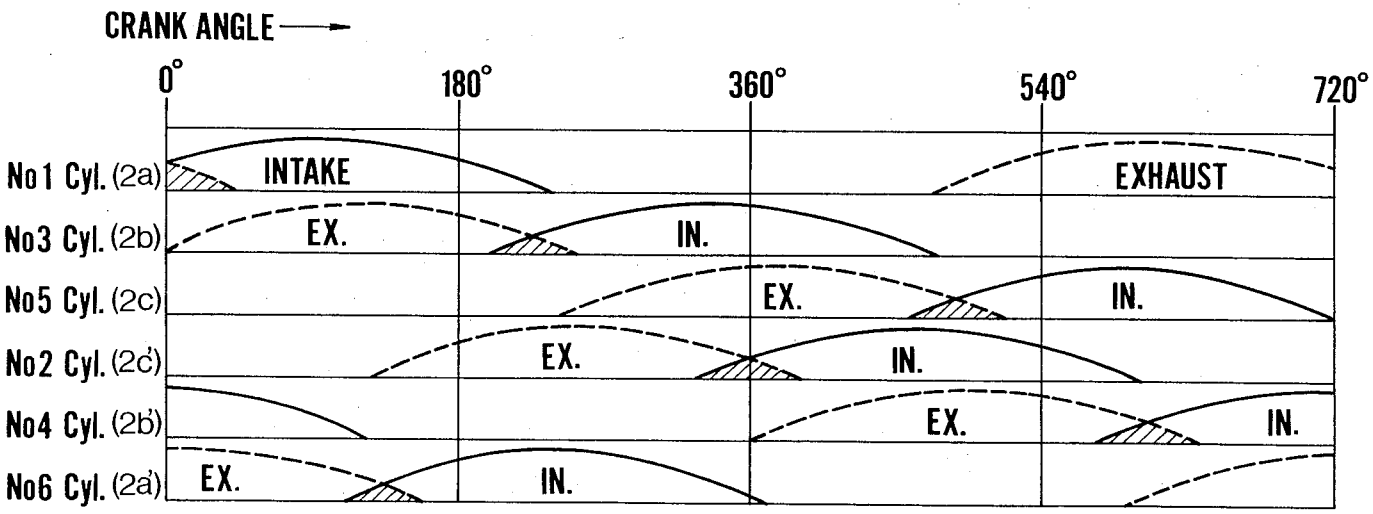
FIG. 6 is a timing chart showing intake strokes and exhaust strokes of the six-cylinder engine.

In FIG. 6, hatched portions show an overlapping period of the exhaust and intake strokes. In this period, induction of residual gases occurs. However, since the intake passages are the same as each other, the induction of residual gases is equal at every cylinder, which insures a uniform combustion.

While the presently referred embodiment of the present invention has been shown and described, it is to be understood that this disclosure is for the purpose of illustration and that various charges and modifications may be made without departing from the spirit and scope of the invention as set forth in the appended claims.

What is claimed is:

1. In cylinder heads of an opposed six-cylinder engine of the type wherein said cylinder heads are disposed on opposite sides of a crankcase including cylinder blocks, each of the latter having three cylinders, the improvement wherein said three cylinders of each block being arranged in firing order;

an intake valve provided in each cylinder head adjacent each of said cylinder respectively communicating therewith;

an exhaust valve provided in each cylinder head adjacent each of said cylinders respectively communicating therewith;

said intake valves and said exhaust valves communicating with each said cylinder being disposed in the same arrangement with respect to said each cylinder so that in each of said cylinder heads respectively the distances between adjacent of the intake valves are equal to each other;

each said cylinder head being formed with: a common intake passage communicating all said intake valves in said each cylinder head with each other, exhaust passages and two openings into said common intake passage and openings out of said exhaust passages, respectively;

each of said two openings in said each cylinder head for the common intake passage in said each cylinder head being located at a position between adjacent of said intake valves in said each cylinder head so that portions of said common intake passage from respective of said two openings to closest of said intake valves in said each cylinder head for every said cylinder are equal in length; and said exhaust passages being exclusively provided for each of said exhaust valves.

2. Cylinder heads according to claim 1 wherein said cylinders in one of said cylinder heads comprises No. 1, No. 3 and No. 5 cylinders in order of firing.

3. The cylinder heads according to claim 1 wherein adjacent of said three cylinders in each of said cylinder blocks have overlapping intake strokes.

* * * * *